US009840917B2

(12) United States Patent
Ring

(10) Patent No.: US 9,840,917 B2
(45) Date of Patent: Dec. 12, 2017

(54) STATOR VANE SHROUD HAVING AN OFFSET

(75) Inventor: Mark David Ring, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 1340 days.

(21) Appl. No.: 13/325,026

(22) Filed: Dec. 13, 2011

(65) Prior Publication Data

US 2013/0149133 A1 Jun. 13, 2013

(51) Int. Cl.
*F01D 5/22* (2006.01)
*F01D 9/04* (2006.01)

(52) U.S. Cl.
CPC ..... *F01D 5/225* (2013.01); *F01D 9/041* (2013.01); *F05D 2250/31* (2013.01); *F05D 2260/30* (2013.01); *F05D 2260/37* (2013.01)

(58) Field of Classification Search
CPC ..... F01D 9/04; F01D 25/246; F01D 5/225; F01D 9/041; F05D 2250/31; F05D 2260/30; F05D 2260/37
USPC ... 415/170.1, 173.1, 173.6, 182.1, 183, 185, 415/189, 191, 208.2, 209.1; 416/185, 416/189, 191, 238; 29/889.22
See application file for complete search history.

(56) References Cited

U.S. PATENT DOCUMENTS 3,368,352 A 2/1968 Hewson
3,533,237 A * 10/1970 Rabone et al. ..... 60/226.1
3,843,279 A 10/1974 Crossley et al.
4,623,298 A 11/1986 Hallinger et al.
4,884,951 A * 12/1989 Meylan et al. ..... 416/191
5,149,250 A 9/1992 Plemmons et al.
5,156,528 A 10/1992 Bobo
5,165,848 A 11/1992 Plemmons
5,176,496 A 1/1993 Correia et al.
5,211,540 A * 5/1993 Evans ..... 416/190
5,829,955 A * 11/1998 Saito et al. ..... 416/191
5,846,050 A 12/1998 Schilling
6,119,339 A * 9/2000 Richter et al. ..... 29/889.22
6,241,471 B1 * 6/2001 Herron ..... 415/190
6,375,415 B1 * 4/2002 Burdgick ..... 415/115
6,390,775 B1 5/2002 Paz
6,398,499 B1 6/2002 Simonetti et al.
6,830,435 B2 * 12/2004 Goetzfried et al. ..... 416/189
(Continued)

FOREIGN PATENT DOCUMENTS

CN 1816682 8/2006
JP 64-36901 6/1988
(Continued)

OTHER PUBLICATIONS

International Search Report and Written Opinion for International Application No. PCT/US2013/068918 dated Jul. 26, 2013.
(Continued)

*Primary Examiner* — Aaron R Eastman
(74) *Attorney, Agent, or Firm* — Carlson, Gaskey & Olds, P.C.

(57) ABSTRACT

An example stator vane assembly of a turbomachine includes a shroud having a leading edge, a trailing edge, and at least one circumferential edge. The leading edge is circumferentially offset relative to the trailing edge when installed within the turbomachine.

20 Claims, 4 Drawing Sheets

(56) References Cited

U.S. PATENT DOCUMENTS

| | | | | |
|---|---|---|---|---|
| 6,860,722 | B2 | 3/2005 | Forrester et al. | |
| 7,270,518 | B2 * | 9/2007 | Barb et al. | 416/191 |
| 2008/0038116 | A1 * | 2/2008 | Zemitis et al. | 416/191 |
| 2009/0155061 | A1 | 6/2009 | Girard et al. | |
| 2009/0314881 | A1 | 12/2009 | Suciu et al. | |
| 2010/0104440 | A1 * | 4/2010 | Torigoe et al. | 416/189 |
| 2010/0150710 | A1 | 6/2010 | Khanin et al. | |
| 2011/0008163 | A1 * | 1/2011 | Prentice et al. | 415/209.3 |
| 2011/0033285 | A1 | 2/2011 | Turi et al. | |
| 2011/0103956 | A1 * | 5/2011 | Borufka et al. | 416/185 |

FOREIGN PATENT DOCUMENTS

| | | |
|---|---|---|
| JP | 2001-132407 | 5/2001 |
| JP | 2001-182696 | 7/2001 |
| JP | 2003-531731 | 10/2003 |
| JP | 2004-232642 | 8/2004 |
| WO | 01/83157 | 11/2001 |
| WO | 2008084038 | 7/2008 |

OTHER PUBLICATIONS

International Patentability for PCT Application No. PCT/US2012/068918 dated Jun. 26, 2014.

Supplementary European Search Report for Application No. 12870209.9 dated Jul. 23, 2015.

* cited by examiner

STATOR VANE SHROUD HAVING AN OFFSET

BACKGROUND

This disclosure relates generally to a stator vane assembly and, more particularly, to a stator vane shroud that limits movement of the stator vane assembly.

Turbomachines typically include arrays of stator vanes distributed circumferentially about an axis. The stator vanes guide fluid through the turbomachine. The fluid moving through the turbomachine loads the stator vanes.

When loaded, circumferentially adjacent stator vanes may undesirably shift axially (or rack) relative to each other. Circumferentially adjacent stator vanes that have circumferentially overlapping portions experience especially high loads, which can increase the likelihood of a shift. A component of the load may be opposite the general direction of flow though the turbomachine.

Some turbomachine compressor cases include an added feature that limits axial movement of the stator vanes to limit undesirable shifts. The feature adds complexity to the turbomachine.

SUMMARY

A stator vane assembly of a turbomachine according to an exemplary embodiment of the present disclosure includes, among other possible things, a shroud having a leading edge, a trailing edge, and at least one circumferential edge. The leading edge is circumferentially offset relative to the trailing edge when installed within the turbomachine.

In a further embodiment of the foregoing stator vane assembly embodiment, the circumferential edge includes a portion that is aligned with an axis of the turbomachine.

In a further embodiment of either of the foregoing stator vane embodiments, a vane extends radially from the shroud.

In a further embodiment of any of the foregoing stator vane embodiments, the vane is a cantilevered vane.

In a further embodiment of any of the foregoing stator vane embodiments, the circumferential edge extends from the leading edge to the trailing edge, and a first portion of the circumferential edge is aligned with, and circumferentially offset from, a second portion of the circumferential edge.

In a further embodiment of any of the foregoing stator vane embodiments, the circumferential edge comprises an angled edge portion extending between the first portion and the second portion.

In a further embodiment of any of the foregoing stator vane embodiments, the angled edge portion has an angle that is offset from the first portion and the second portion, the angled edge portion configured to be spaced from an angled edge portion of a circumferentially adjacent vane.

In a further embodiment of any of the foregoing stator vane embodiments, the shroud is configured to contact a circumferentially adjacent shroud exclusively through portions of the circumferential edge other than the angled edge portion when loaded during operation of the turbomachine.

In a further embodiment of any of the foregoing stator vane embodiments, the circumferential edge has a step area.

In a further embodiment of any of the foregoing stator vane embodiments, the circumferential edge includes a first and a second circumferential edge of the shroud, the first circumferential edge mimicking a profile of the second circumferential edge.

In a further embodiment of any of the foregoing stator vane embodiments, the shroud is an outer diameter shroud.

A turbine engine according to another exemplary embodiment of the present disclosure includes, among other possible things, a stator vane array including a plurality of stator vanes distributed circumferentially about an axis. Each of the stator vanes including a shroud and a vane extending from the shroud toward the axis. Each of the stator vanes is circumferentially loaded against a circumferentially adjacent stator blade during operation. At least one of the shrouds has a leading edge, a trailing edge, and at least one circumferential edge. The leading edge is circumferentially offset relative to the trailing edge.

In a further embodiment of the foregoing turbine engine embodiment, the stator vanes are cantilevered stator vanes.

In a further embodiment of either of the foregoing turbine engine embodiments, the shroud is a radially outer shroud.

In a further embodiment of any of the foregoing turbine engine embodiments, the shroud interfaces with a circumferentially adjacent shroud along a circumferential edge that includes a step area.

In a further embodiment of any of the foregoing turbine engine embodiments, each of the plurality of stator vanes includes a single shroud and a single vane.

In a further embodiment of any of the foregoing turbine engine embodiments, the stator vane array is a nonrotating array.

In a further embodiment of any of the foregoing turbine engine embodiments, a fan or a compressor contains the stator vane array.

In a further embodiment of any of the foregoing turbine engine embodiments, a bypass ratio of the volume of air that passes through the fan and that does not pass through the compressor to the volume of air that passes through the fan and through the compressor is greater than 10.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
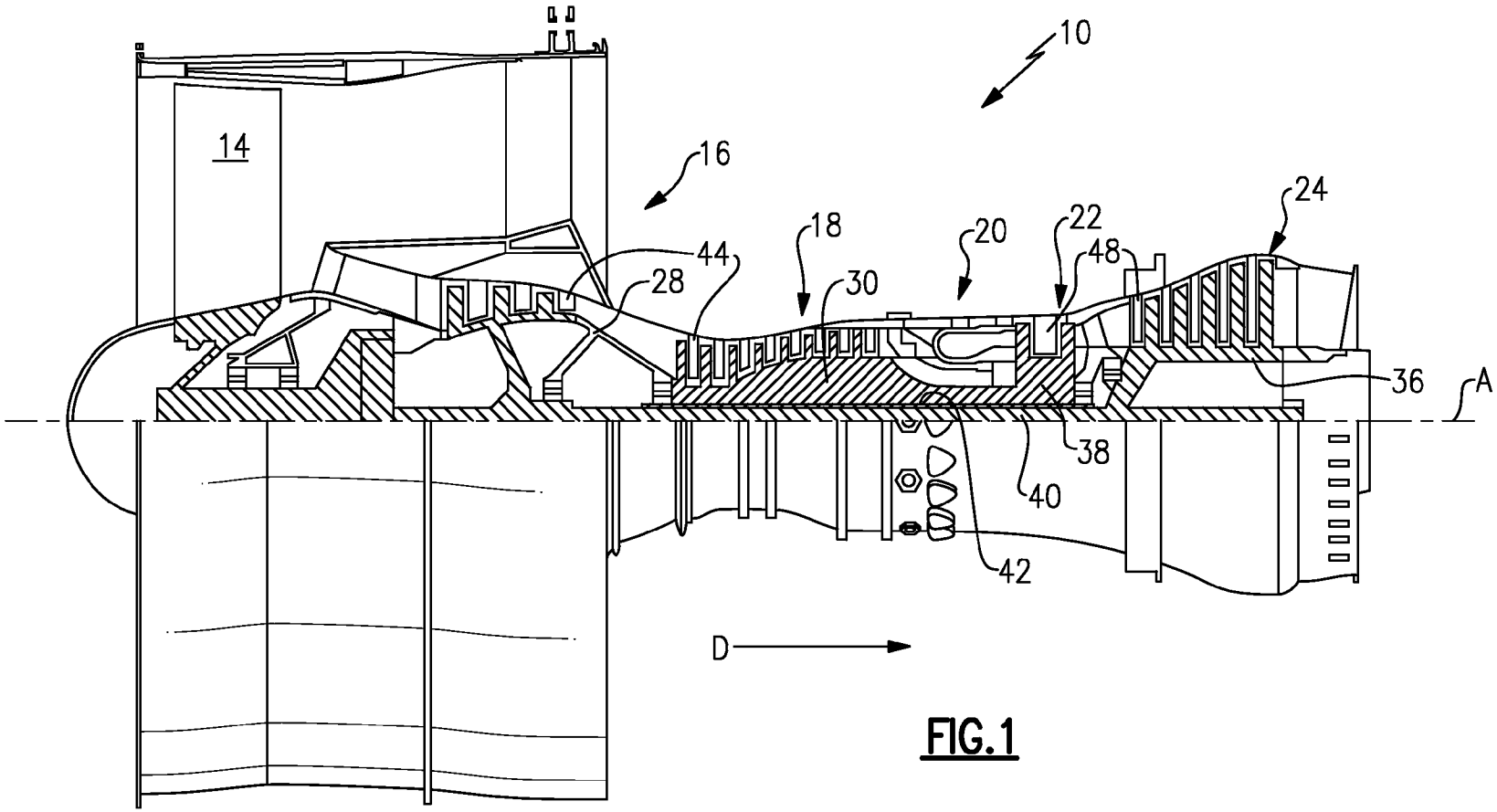
FIG. 1 shows a section view of an example turbomachine.

Referring to FIG. 1, an example turbomachine, such as a gas turbine engine 10, is circumferentially disposed about an axis A. The gas turbine engine 10 includes a fan 14, a low-pressure compressor section 16, a high-pressure compressor section 18, a combustion section 20, a high-pressure turbine section 22, and a low-pressure turbine section 24. Other example turbomachines may include more or fewer sections.

The engine 10 in the disclosed embodiment is a high-bypass geared architecture aircraft engine. In one disclosed embodiment, the engine 10 bypass ratio is greater than ten (10:1), the diameter of the turbofan 14 is significantly larger than that of the low pressure compressor 16, and the low pressure turbine 24 has a pressure ratio that is greater than 5:1. It should be understood, however, that the above parameters are only exemplary of one embodiment of a geared architecture engine and that the present application is applicable to other gas turbine engines including direct drive turbofans.

During operation, air is compressed in the low-pressure compressor section 16 and the high-pressure compressor section 18. The compressed air is then mixed with fuel and burned in the combustion section 20. The products of combustion are expanded across the high-pressure turbine section 22 and the low-pressure turbine section 24. Flow of air moves through the gas turbine engine 10 generally in a direction F.

The low-pressure compressor section 16 and the high-pressure compressor section 18 each include rotors 28 and 30, respectively. The high-pressure turbine section 22 and the low-pressure turbine section 24 each include rotors 36 and 38, respectively. The rotors 36 and 38 rotate in response to the expansion to rotatably drive rotors 28 and 30. The rotor 36 is coupled to the rotor 28 with a spool 40, and the rotor 38 is coupled to the rotor 30 with a spool 42.

Arrays 44 of guide vanes are used to guide flow through the various stages of the low-pressure compressor section 16 and the high-pressure compressor section 18. Other arrays 48 of guide vanes are used to guide flow through the various stages of the low-pressure turbine section 22 and the high-pressure turbine section 24.

The examples described in this disclosure are not limited to the two-spool gas turbine architecture described, however, and may be used in other architectures, such as the single-spool axial design, a three-spool axial design, and still other architectures. That is, there are various types of gas turbine engines, and other turbomachines, that can benefit from the examples disclosed herein.

Figure 2:
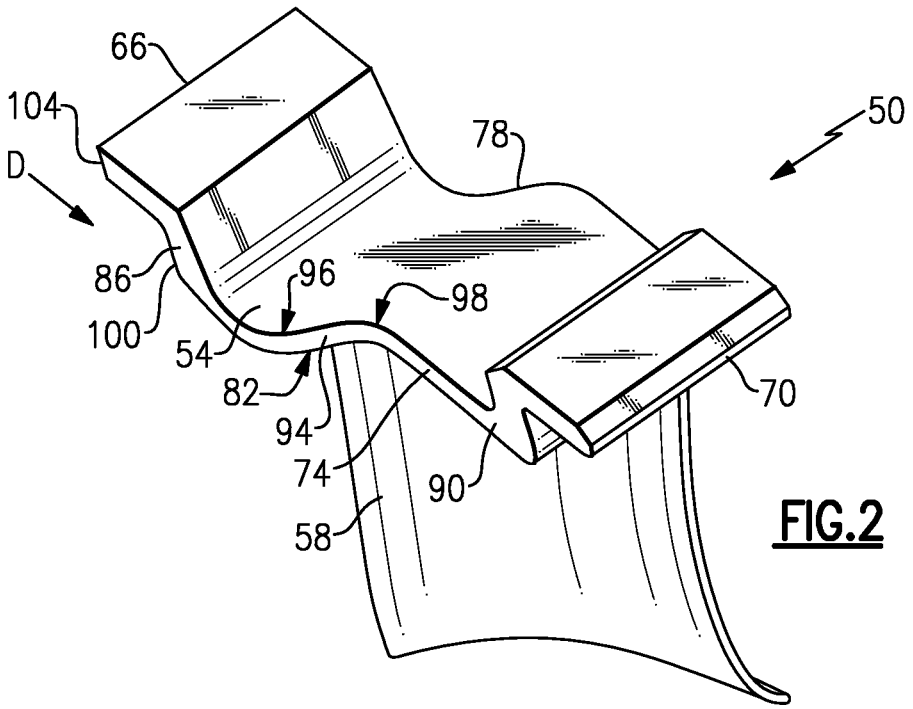
FIG. 2 shows a perspective view of an example stator vane assembly of the FIG. 1 turbomachine.
Figure 3:
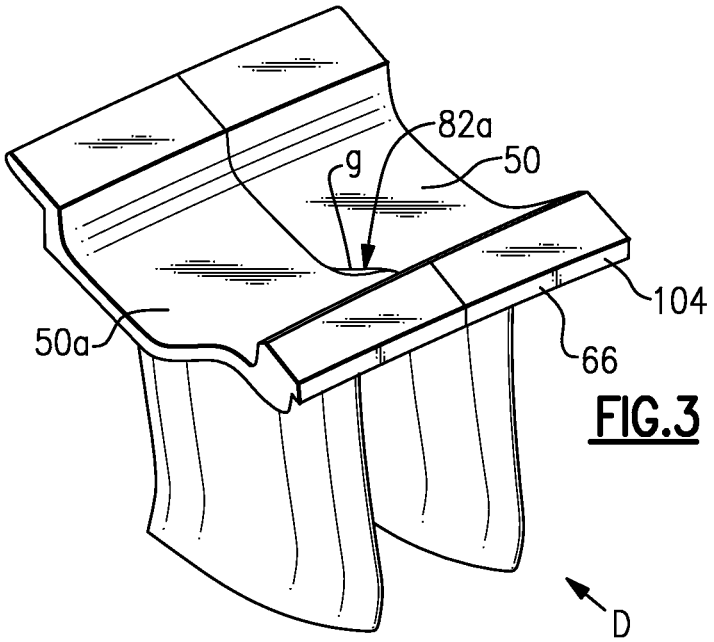
FIG. 3 shows a perspective view of the FIG. 2 stator vane assembly interfacing with a circumferentially adjacent stator vane assembly.
Figure 4:
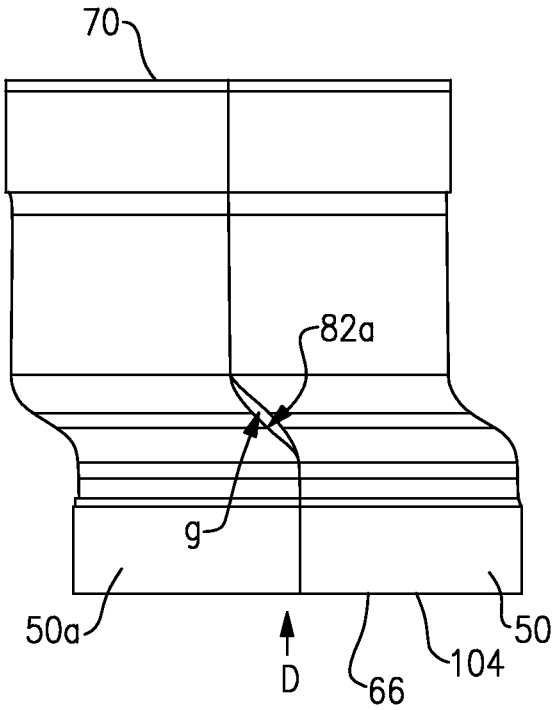
FIG. 4 shows the radially outward facing surfaces of the FIG. 3 stator vane assemblies.
Figure 5:
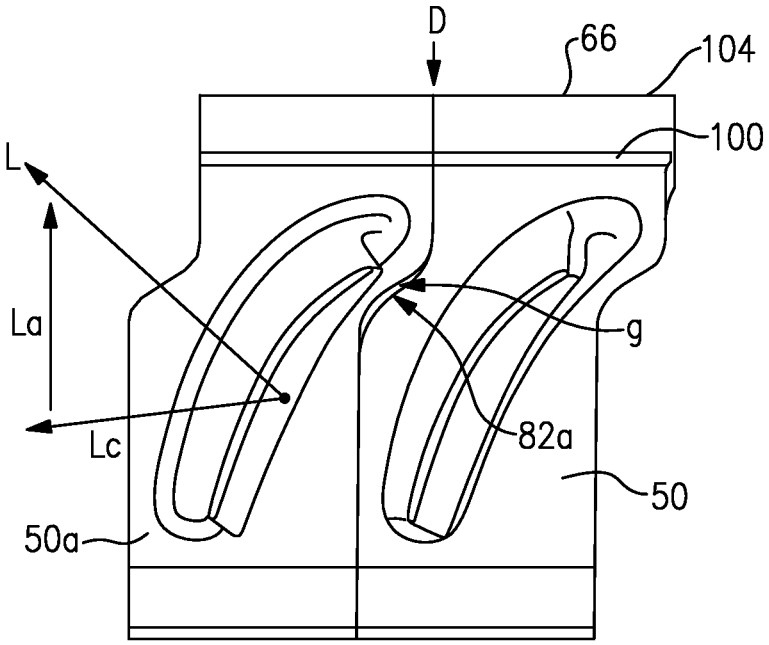
FIG. 5 shows the radially inward facing surfaces of the FIG. 3 stator vane assemblies.
Figure 6:
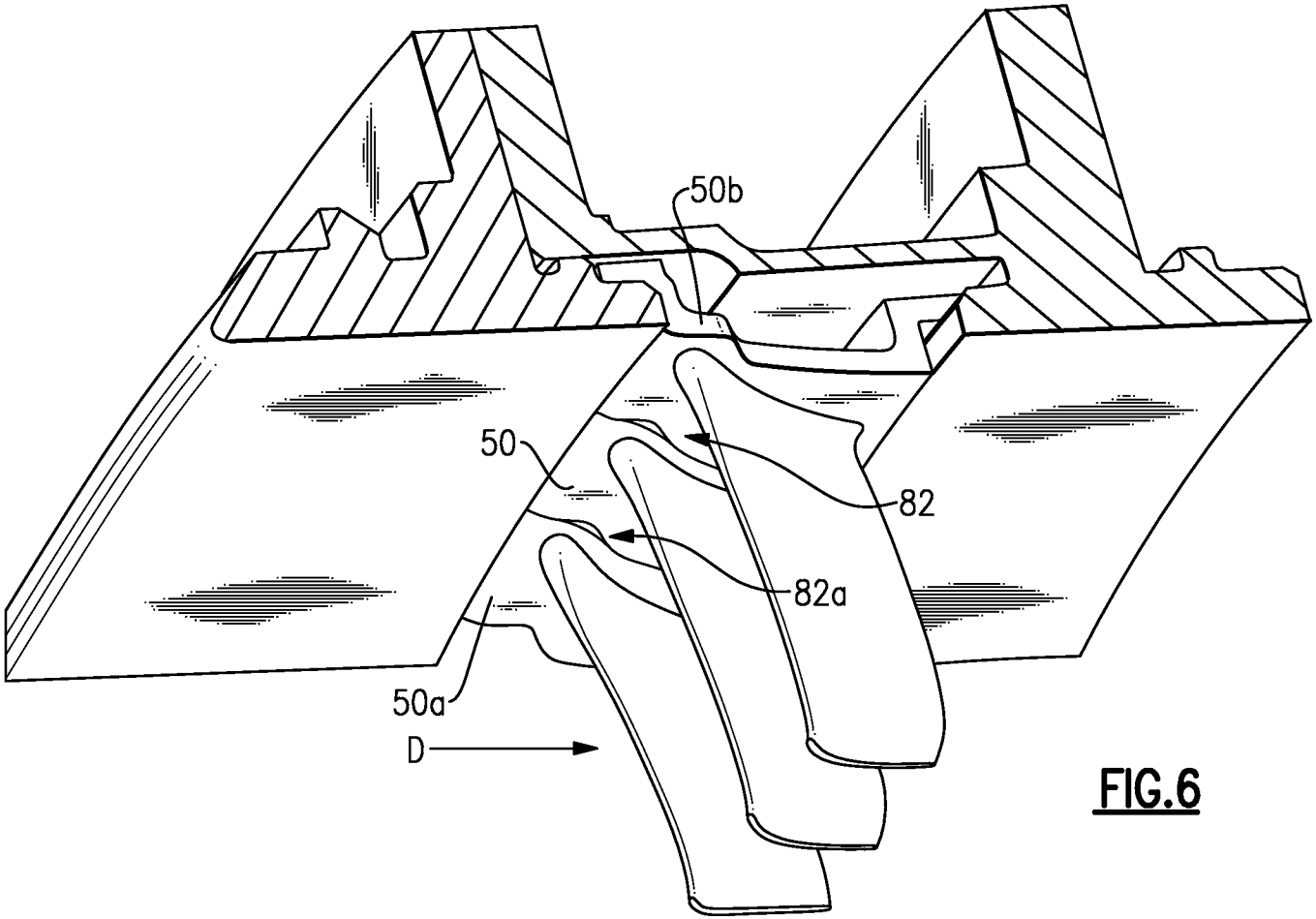
FIG. 6 shows a perspective view of the FIG. 2 stator vane assembly interfacing with two circumferentially adjacent stator vane assemblies within a sectioned portion of the FIG. 1 turbomachine.

Referring to FIG. 2 with continuing reference to FIG. 1, a stator vane assembly 50 of the gas turbine engine 10 includes a shroud 54 and a vane 58. The example stator vane assembly 50 is one of several stator vane assemblies within one of the arrays 44 of stator vane assemblies in the high-pressure compressor section 18 of the gas turbine engine 10.

The example vane 58 extends radially from the shroud 54 toward the axis A. The shroud 54 is thus considered an outer shroud. The example stator vane assembly 50 includes a single shroud, and is thus considered a cantilevered stator vane assembly.

Only one vane 58 extends from the example shroud 54. In other examples, more than one vane 58 may extend from the shroud 54.

The shroud 54 includes an axially leading edge 66 and an axially trailing edge 70. The designations as leading and trailing are relative a general direction of flow through the gas turbine engine 10. Notably, the axially leading edge 66 is circumferentially offset relative to the axially trailing edge 70. That is, the axially leading edge 66 is not in circumferential alignment with the axially trailing edge 70.

Circumferential edges 74 and 78 of the shroud 54 extend from the leading edge 66 to the trailing edge 70. The circumferential edges 74 and 78 include a step area 82. The step area 82 transitions the circumferential edges 74 and 78 from a circumferential position aligned with the leading edge 66 to a circumferential position aligned with the trailing edge 70.

The circumferential edge 74 includes a first axially extending portion 86, a second axially extending portion 90, and an angled edge portion 94. The angled edge portion 94 extends between the first axially extending portion 86 and the second axially extended portion 90. In this example, the first and second axially extending portions 86 and 90 are parallel to the axis A.

An outer radius 96 transitions the angled edge portion 94 into the first axially extending portion 86. An inner radius 98 transitions the angled edge portion 94 into the second axially extending portion 90.

In this example, the axially extending portions 86 and 90 are both aligned with the axis A. The angled edge portion 94 is about 45° offset from the axially extending portions 86 and 90.

In this example, the profile of the circumferential edge 78 mimics the profile of the circumferential edge 74. The circumferential edges of circumferentially adjacent stator vanes also mimic the profiles of the circumferential edge 74. The circumferentially adjacent stator vanes are thus able to nest with the stator vane assembly 50 when in installed positions within the gas turbine engine 10.

Although the profiles of the circumferential edges generally mimic each other, the example circumferentially edges are not exact replicas of each other. For example, the step area 82 is designed to be spaced slightly from a step area of a circumferentially adjacent stator vane. The first and second axially extending portions 86 and 90, by contrast, are designed to directly contact the axially extending portions of the circumferentially adjacent stator vane.

Referring now to FIGS. 3-6 with continuing reference to FIGS. 1-2, during operation of the gas turbine engine 10, flow of a working fluid moves in the direction D past the stator vane assembly 50, a circumferentially adjacent stator vane assembly **50*a*, and a circumferentially adjacent stator vane assembly 50*b*. The fluid moving through the gas turbine engine 10 loads the stator vane assemblies 50, 50*a*, and 50*b*, as is known. The load L on these stator vane assemblies 50, 50*a*, and 50*b*** has at least an axial component $L_a$ and a circumferential component $L_c$. Notably, the axial component $L_a$ is opposite the direction D.

In this example, the step area 82 of the stator vane assembly 50 and a step area **82*a* of the stator vane assembly 50*a* are spaced slightly from each other. Thus, there is a gap g between the step area 82 and the step area 82*a*. Because of the gap g, none of the load L is transferred from the stator vane assembly 50 to the stator vane assembly 50*a* through the step area 82 and the step area 82*a*. Instead, the axial component $L_a$ is directed through surface 100, and perhaps surface 104, at the leading edge 66**.

In other examples, the step area 82 may contact the step area **82*a*; however, there is still no significant load transfer through the step area 82 and the step area 82*a***.

Directing the axial component $L_a$ through the surfaces 100 and 104, and the circumferential component $L_c$ though the axially extending portions 86 and 90, does not encourage the stator vane assembly 50 to shift or rack relative to the stator vane assembly **50*a*. Limiting shifting and raking limits axial misalignment between the stator vane assembly 50 and the stator vane assembly 50*a***.

Because of the step area 82, the shroud 54 may be considered to have a chevron shape or profile. Because of the step area 82, surfaces of the shroud 54 that face axially contact the adjacent surfaces of the stator vane assembly **50*a* adjacent thereto, when the vane assemblies 50 and 50*a*** are loaded.

Features of the disclosed examples include a stator vane shroud having a step area that limits relative movement between the stator vane shroud and a circumferentially adjacent shroud. Incorporating the limiting feature into the shroud eliminates the need for features in the case to prevent such racking movements. The disclosed examples limit racking geometrically.

Although the different examples have the specific components shown in the illustrations, embodiments of this invention are not limited to those particular combinations. It is possible to use some of the components or features from one of the examples in combination with features or components from another one of the examples.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A stator vane assembly of a turbomachine, comprising:

a shroud having a leading edge, a trailing edge, and a circumferential edge, wherein the leading edge is circumferentially offset relative to the trailing edge when installed within the turbomachine, wherein the at least one circumferential edge extends from the leading edge to the trailing edge, and a first portion of the circumferential edge is aligned with, and circumferentially offset from, a second portion of the circumferential edge, wherein the circumferential edge comprises an angled edge portion extending between the first portion and the second portion, wherein the shroud is configured to contact a circumferentially adjacent shroud exclusively through portions of the circumferential edge other than the angled edge portion when loaded during operation of the turbomachine.

2. The stator vane assembly of claim 1, wherein the circumferential edge includes a portion that is aligned with an axis of the turbomachine.

3. The stator vane assembly of claim 1, including a vane extending radially from the shroud.

4. The stator vane assembly of claim 3, wherein the vane is a cantilevered vane.

5. The stator vane assembly of claim 4, wherein the vane extends exclusively from the shroud such that the stator vane assembly includes no more than one shroud.

6. The stator vane assembly of claim 1, wherein the angled edge portion has an angle that is offset from the first portion and the second portion, the angled edge portion configured to be spaced from an angled edge portion of a circumferentially adjacent vane.

7. The stator vane assembly of claim 1, wherein the circumferential edge has a step area.

8. The stator vane assembly of claim 1, wherein the at least one circumferential edge includes a first and a second circumferential edge of the shroud, the first circumferential edge mimicking a profile of the second circumferential edge.

9. The stator vane assembly of claim 1, wherein the shroud is an outer diameter shroud.

10. The stator vane assembly of claim 1, wherein the shroud is configured to contact the circumferentially adjacent shroud exclusively through the first portion and the second portion, the first portion upstream from the angled edge portion, the second portion downstream from the angled edge portion.

11. A turbine engine, comprising:

a stator vane array including a plurality of stator vanes distributed circumferentially about an axis, each of the plurality of stator vanes including a shroud and a vane extending from the shroud toward the axis, wherein each of the plurality of stator vanes is circumferentially loaded against a circumferentially adjacent stator blade during operation, wherein at least one of the shrouds has a leading edge, a trailing edge, and a circumferential edge, wherein the leading edge is circumferentially offset relative to the trailing edge, wherein the shroud is configured to contact a circumferentially adjacent shroud exclusively through portions of the circumferential edge other than an angled edge portion when loaded during operation of the turbomachine.

12. The turbine engine of claim 11, wherein the plurality of stator vanes are cantilevered stator vanes.

13. The turbine engine of claim 11, wherein the shroud is a radially outer shroud.

14. The turbine engine of claim 11, wherein each of the plurality of stator vanes includes a single shroud and a single vane.

15. The turbine engine of claim 11, wherein the stator vane array is a nonrotating array.

16. The turbine engine of claim 11, further comprising a fan and a compressor that contains the stator vane array.

17. The turbine engine of claim 16, wherein a bypass ratio of the volume of air that passes through the fan and that does not pass through the compressor to the volume of air that passes through the fan and through the compressor is greater than 10.

18. The turbine engine of claim 11, wherein the at least one circumferential edge extends from the leading edge to the trailing edge, and a first portion of the circumferential edge is aligned with, and circumferentially offset from, a second portion of the circumferential edge, wherein the circumferential edge comprises an angled edge portion extending between the first portion and the second portion.

19. The turbine engine of claim 11, wherein the shroud of each of the plurality of stator vanes is the exclusive shroud of each of the plurality of stator vanes such that each of the plurality of stator vanes is directly attached to no more than one shroud.

20. The turbine engine of claim 11, wherein the shroud is configured to contact a circumferentially adjacent shroud exclusively through portions of the circumferential edge other than an angled edge portion when loaded during operation of the turbomachine such that a gap is provided between the shroud and the adjacent shroud, the gap having a perimeter defined entirely by the shroud and the circumferentially adjacent shroud.

* * * * *